US005247969A

United States Patent [19]

Raaijmakers et al.

[11] Patent Number: 5,247,969

[45] Date of Patent: Sep. 28, 1993

[54] FEEDING AND REMOVING WEFT YARN STOCK BOBBINS TO A LOOM BOBBIN FRAME

[75] Inventors: Tonny Raaijmakers, Winterthur, Switzerland; Antonius J. M. Hamer, Eindhoven, Netherlands; Gregor Gebald; Manfred Langen, both of Mönchengladbach, Fed. Rep. of Germany; Helmut Bungter, Viersen, Fed. Rep. of Germany; Hans-Peter Schmitz, Mönchengladbach, Fed. Rep. of Germany

[73] Assignee: Sulzer Brothers Limited, Winterthur, Switzerland

[21] Appl. No.: 883,599

[22] Filed: May 14, 1992

[30] Foreign Application Priority Data

May 15, 1991 [CH] Switzerland ..... 1456/91

[51] Int. Cl.[5] ..... D03D 47/28; D03D 47/34

[52] U.S. Cl. ..... 139/450; 139/1 R; 242/35.5 A; 242/131

[58] Field of Search ..... 242/35.5 A, 131, 35.5 T, 242/35.6 R; 139/450, 1 R

[56] References Cited

U.S. PATENT DOCUMENTS

| | | | |
|---|---|---|---|
| 4,974,641 | 12/1990 | Yarita et al. | 139/1 R |
| 5,000,231 | 3/1991 | Takehana et al. | 139/450 |
| 5,096,357 | 3/1992 | Galbani | 242/35.5 A X |

FOREIGN PATENT DOCUMENTS

| | | |
|---|---|---|
| 0144652 | 6/1985 | European Pat. Off. . |
| 0225670 | 6/1987 | European Pat. Off. . |
| 0404717 | 12/1990 | European Pat. Off. . |
| 0421362 | 4/1991 | European Pat. Off. . |

OTHER PUBLICATIONS

Patent Abstracts of Japan; vol. 14, No. 310 (C-736) (4253) Jul. 4, 1990; & JP, A,2 010 478 (Tsudakoma Corp) Apr. 17, 1990.

Patent Abstracts of Japan; vol. 14, No. 310 (C-736) (4253) Jul. 4, 1990; & JP, A,2 104 745 (Tsudakoma Corp) Apr. 17, 1990.

*Primary Examiner*—Andrew M. Falik

*Attorney, Agent, or Firm*—Townsend and Townsend, Khourie and Crew

[57] ABSTRACT

A mechanism for feeding weft yarn stock bobbins to a loom includes a bobbin frame (3) for at least two stock bobbins (4) which may be fitted to bobbin holders (38) having longitudinal axes (L) which may be aligned on a common yarn guide member (6). The bobbin holders (38) are each formed on a bobbin carrier (10, 10') intended for receiving one of the stock bobbins (4) and able by means of a holder (30) of a charging mechanism to be fastened to the bobbin frame (3) and removed from the bobbin frame, the bobbin carrier having a yarn guide unit (45) for feeding the piece (A) at the start of the weft yarn (5) wound onto this stock bobbin (4) to the common yarn guide member (6). The yarn guide unit (45) is formed on a carrier part (44) able to swing between a normal position suitable for seizing the starting piece (A) and a deflected position in which in an operating position of the bobbin carrier (10, 10') predetermined on the bobbin frame (3) and aligned with the yarn guide member (6), the yarn guide unit (45) may be set in a definite yarn delivery position and may be brought together with the yarn guide member (6). A simplification of the charging process and delivery of the yarn is accordingly achievable.

12 Claims, 4 Drawing Sheets

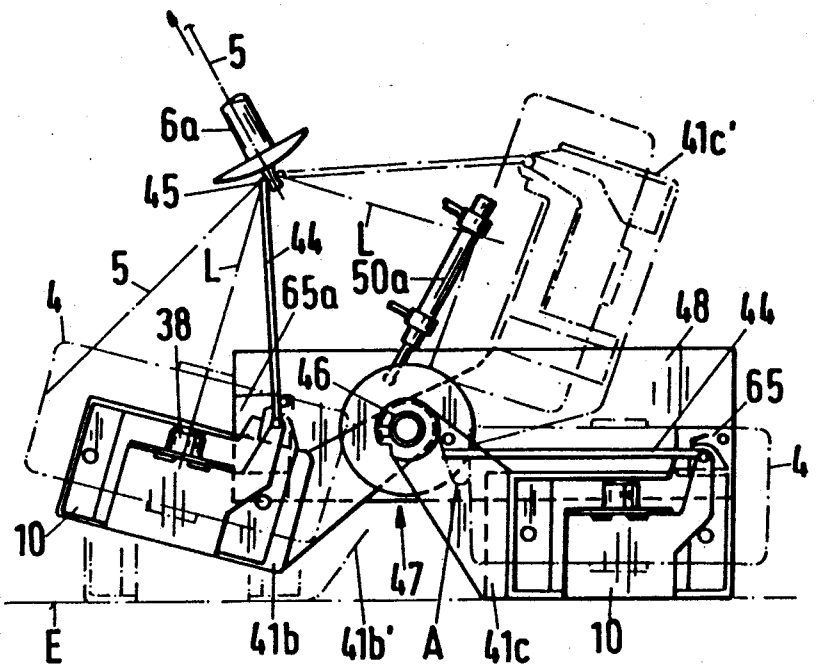
Fig.7
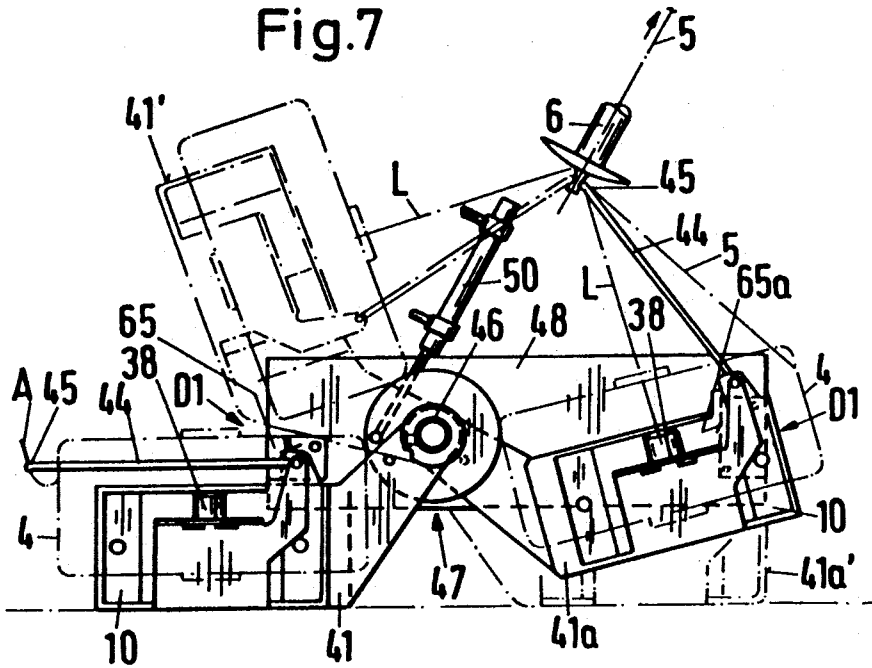
Fig.7b
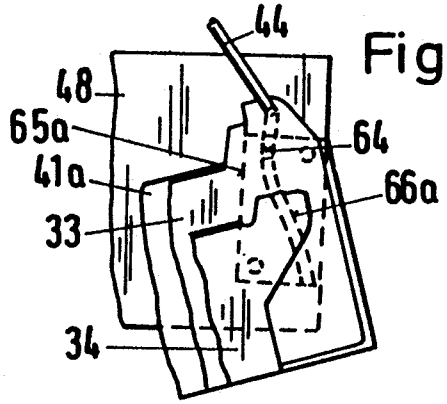
Fig.8
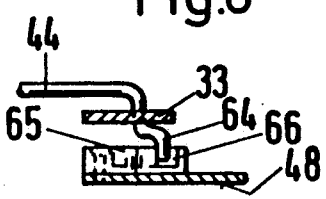
Fig.7a
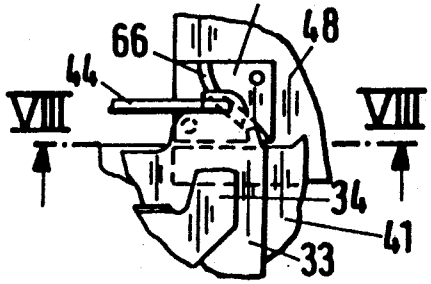

FEEDING AND REMOVING WEFT YARN STOCK BOBBINS TO A LOOM BOBBIN FRAME

BACKGROUND OF THE INVENTION

The invention is concerned with a mechanism for feeding weft yarn stock bobbins to a loom and for carrying bobbin tubes of run-off stock bobbins away from the loom. A mechanism for feeding weft-yarn stock bobbins to a loom and for carrying away from the loom the bobbin tubes of stock bobbins which have been run off. The mechanism has a bobbin frame associated with the loom for at least two stock bobbins which may be fitted to bobbin holders with longitudinal axes. The bobbin holders may be aligned in relation to a common yarn guide member. A charging mechanism is movable towards the bobbin frame and away from it for exchanging for a fresh stock bobbin the bobbin tube of the stock bobbin which has been run off at the time. The mechanism also includes a delivery device for feeding to the common yarn guide member the piece at the start of the weft yarn wound on this stock bobbin.

The invention is further concerned with a method of operation of the mechanism.

In known mechanisms for feeding weft yarn stock bobbins to a loom from the EP-A 0 363 909 a number of stock bobbins is arranged on bobbin holders with their longitudinal axes aligned in a predetermined operating position with a common yarn guide member on the loom, associated with these bobbin holders. The bobbin holders are hinged to stationary carriers on a bobbin frame and each is pivotable between the operating position in question and a charging position intended for facilitating the exchange of the bobbin tube of the run-off stock bobbin for a fresh stock bobbin. In the case of the known mechanism, a delivery device is fitted to a pivotable arm on the charging mechanism. The delivery device has pneumatically actuated grippers for seizing the piece of weft yarn at the start of that wound onto the stock bobbin, by which the starting piece is seized and delivered to a positioning device which is arranged on the bobbin frame and by which the starting piece is fed to a suction tube of a delivery device for the weft yarn at the side of the loom.

The known mechanism demands a relatively elaborate control of the gripper and guide members for the stock bobbins which have to be mounted and the piece at the start of the weft yarn which has to be delivered. At every bobbin change the members have to be actuated and exactly positioned in the region of the bobbin frame.

The problem underlying the invention is to create a mechanism of the kind named initially, which enables simplification of the charging process and a shortening of the time it was hitherto necessary to spend on doing this.

SUMMARY OF THE INVENTION

This problem is solved by the present invention. Each bobbin holder is formed on a bobbin carrier which is intended for receiving at least one of the stock bobbins and may be fastened to and removed from the bobbin frame by the charging mechanism. At least one yarn guide unit is fitted to each of the bobbin carriers for delivering the piece at the start of the weft yarn. The yarn guide has a predetermined operating position on the bobbin frame, aligned on the common yarn guide member, which may be set in a definite yarn-delivery position and brought together with the yarn guide member.

The mechanism in accordance with the invention allows charging of the bobbin carrier in a charging station remote from the bobbin frame, largely independently of influences on the part of the loom and unimpaired by the restricted conditions of space at the bobbin frame. The yarn guide unit fitted to the bobbin carrier further allows seizing of the piece at the start of the weft yarn wound onto the stock bobbin, in a region equally remote from the bobbin frame so that the charging process is restricted essentially to taking the bobbin carrier containing the empty bobbin tube off the bobbin frame, fitting the bobbin carrier containing the fresh bobbin in the predetermined operating position on the bobbin frame and setting the yarn guide unit in the yarn delivery position.

Through the method of operation in accordance with the invention—in comparison with executions hitherto—a considerable simplification of the charging process may be achieved and thereby a reduction in the time it is necessary to spend on this, in which case in particular a relatively simple control may be provided and a greater number of looms charged with stock bobbins per unit of time than hitherto.

Further details follow from the description below of embodiments of the invention represented diagrammatically in the drawings.

BRIEF DESCRIPTION OF THE DRAWINGS

FIG. 7 a partial plan corresponding with FIG. 5, of a loom with a mechanism in accordance with the invention in another embodiment;

FIGS. 7*a* and 7*b* details D1 and D2 from FIG. 7, each on a larger scale; and FIG. 8 the section VIII—VIII from FIG. 7*a*.

DESCRIPTION OF PREFERRED EMBODIMENT

Figure 1:
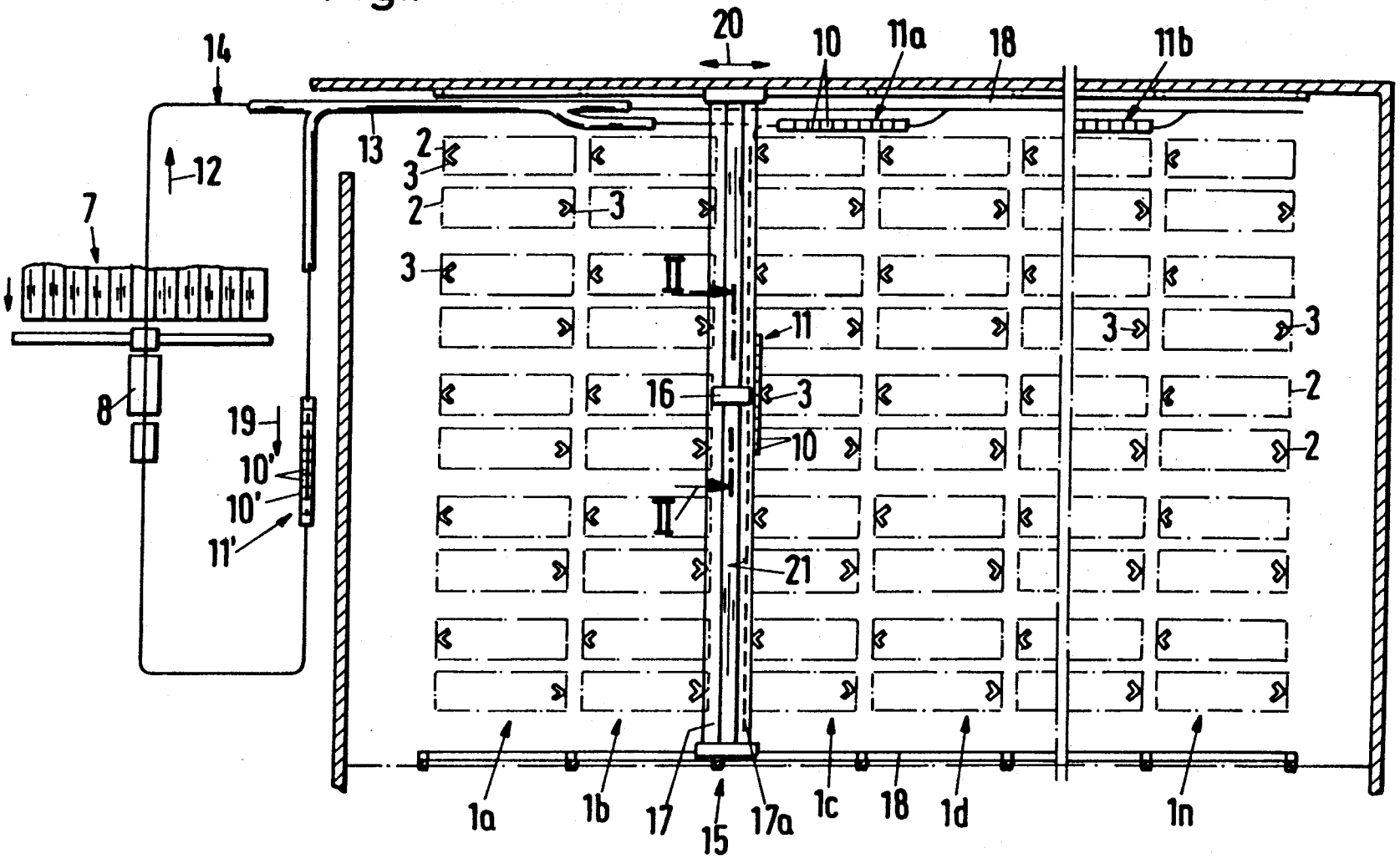
FIG. 1 an installation of looms in a simplified plan.
Figure 2:
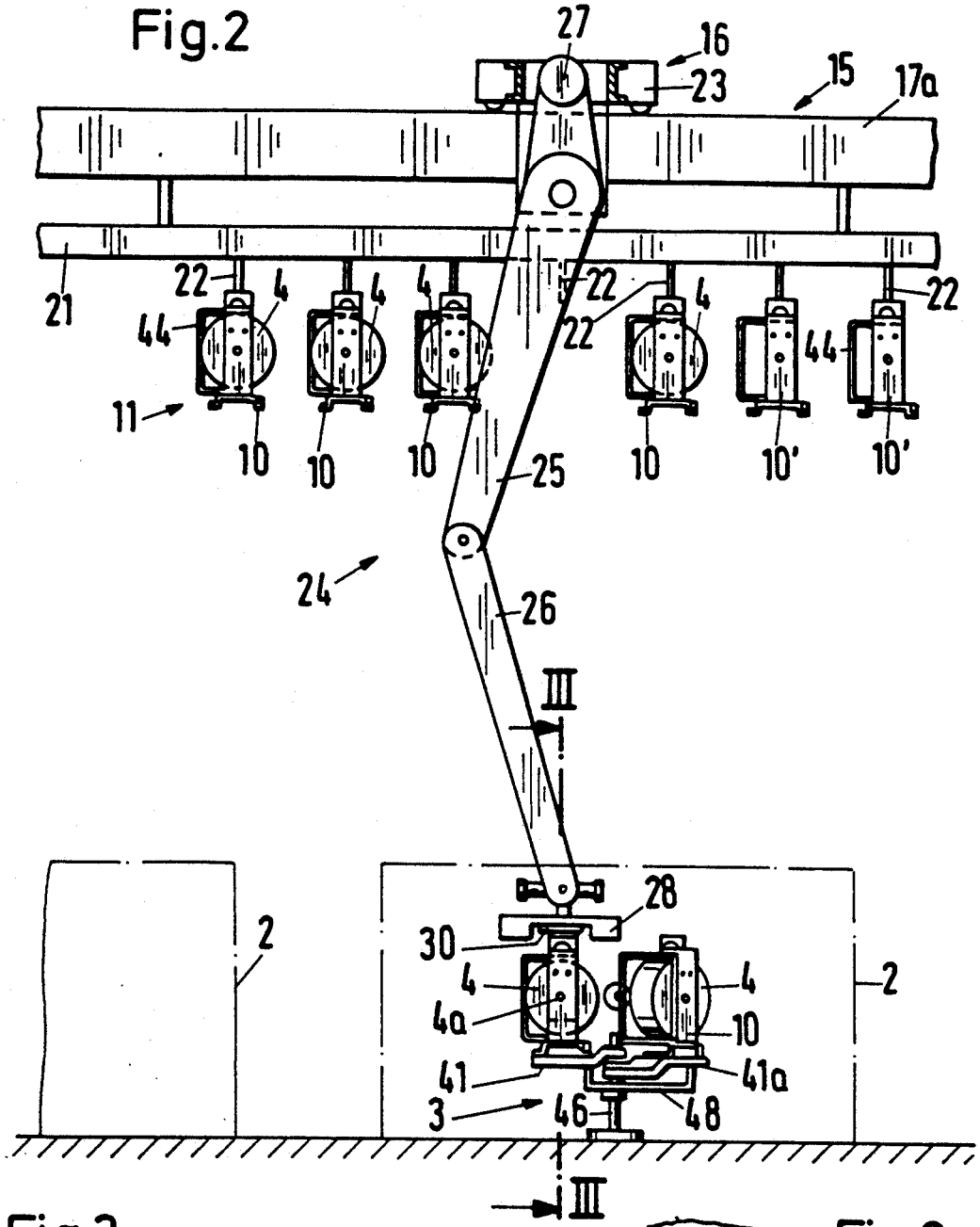
FIG. 2 a loom provided with a mechanism constructed in accordance with the invention, in a partial elevation partially sectioned to correspond with the line II—II in FIG. 1.

The installation according to FIG. 1 contains a number of groups of looms 1*a*, 1*b*, 1*c*, 1*d* . . . 1*n* which are arranged in rows in a weaving shed and separated from one another by alleyways and each of which in accordance with the illustration exhibits ten looms 2. In the simplified plan according to FIG. 1, the looms 2 are represented by rectangular areas each of which contains a bobbin frame 3 indicated at one narrow side for, receiving at least two weft yarn stock bobbins 4 (FIG. 2). One of the bobbins 4 serves as the draw-off bobbin and the other as standby bobbin. The stock bobbins 4 are fitted to the bobbin frame 3 in a way still to be described. The piece A at the start of a weft yarn 5 wound onto the draw-off bobbin is fed by a yarn guide member associated with both stock bobbins 4, in accordance with FIG. 5 a suction tube 6, via a yarn store (not shown) to a weft insertion device and becomes inserted by a fluid weft insertion medium, e.g., compressed air, or a mechanical weft insertion member, e.g., a gripper belt, a gripper rod or a projectile, into the shed of the loom in parallel with the long sides of the rectangular area.

The stock bobbins 4 are fed from a winding or spinning installation (not shown) and/or a bobbin store via an assembly station 7 to a preparation station 8 provided outside the weaving shed stock bobbins 4 are fitted to bobbin carriers 10 to correspond with the need of bobbins detected at any time, of a predetermined number of looms 2, e.g., the looms of the groups 1*b* and 1*c* having the bobbin frames 3 next the common alleyway. The bobbin carriers 10 are assembled into transport units 11 and in accordance with the arrow 12 are brought by guiderails 13 of a transport loop 14 into a waiting position 11*a* or 11*b* provided in the weaving shed, from which the transport unit 11 may be brought at any time by a transport mechanism 15 into a charging position associated with the group of looms concerned, namely 1*b* and 1*c* in accordance with the illustration via a charging mechanism 16 one of the bobbin carriers 10 selected according to the need of bobbins may be fed at any time to the bobbin frame 3 and there be exchanged for a corresponding spent bobbin carrier 10' which is carrying an empty bobbin tube 4*a* of a run-off stock bobbin 4 or a defective stock bobbin 4 which is to be removed because, e.g., after an excess of yarn breakages it was put out of operation by a control device of the loom. The bobbin carriers 10' are carried by the charging mechanism 16 in a corresponding way towards the transport mechanism 15 by the latter as a transport unit 11' towards the transport loop 14. In accordance with the arrow 19 the bobbin carriers 10' are carried via the transport loop 14 back towards the preparation station 8 in which they are freed of the bobbin tubes 4*a* or respectively of the defective bobbin and charged with fresh stock bobbins 4.

The transport mechanism 15 contains a crane beam having two bearer rails 17 and 17*a* which extend over part of the width of the weaving shed or as shown, over its whole width, and in accordance with the arrows 20 are guided along rails 18 at the sides so that they may be adjusted and fixed. As appears in particular from FIG. 2, a guiderail 21 may be fastened to the bearer rail 17*a* in which carriers 22 for receiving the bobbin carriers 10 and 10' are guided to be able to shift across the width of the weaving shed. The charging mechanism 16 is arranged between the bearer rails 17 and 17*a* and guided to be able to shift along them by a crab 23. The charging mechanism 16 which may be of any execution contains, in the case of the embodiment according to FIG. 2, a manipulator arm 24 like a toggle lever with a first lever 25 hinged to a driving mechanism 27 and a second lever 26 hinged to the first. The levers 25 and 26 are adjustable by the driving mechanism 27 between a "folded together" transfer position adjacent to the guiderail 21 and a charging position corresponding with the illustration according to FIG. 2, associated with the bobbin frame 3 of one of the looms 2 to be charged at the time.

Figure 3:
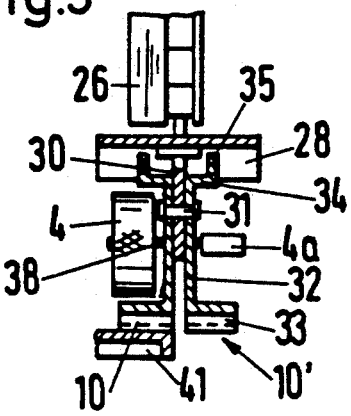
FIG. 3 a partial section corresponding with the line III—III in FIG. 2.

At the free end of it the second lever 26 is provided with a gripper 28 for seizing and releasing one of the bobbin holders 10 or 10' at a time. In accordance with the illustration the gripper 28 may have a mounting 30 in the form of a plate able to turn about a vertical axis, which is made with two studs 31 (FIG. 3) standing out on opposite sides, on which two bobbin carriers 10 or 10' may be suspended at a time.

The bobbin carriers 10 and 10' are each made with a substantially U-shaped profile which exhibits a wall part 32 with side parts 32*a*, which may be fitted upright on the bobbin frame 3, a lower flange part 33 and an upper flange part 34. On the guide part 34 a bracket 35 is formed, provided with an opening 36 by which the bobbin carrier 10 or 10' concerned may be suspended on one of the carriers 22 of the transport unit 11. In accordance with the illustration the racket 35 may be arranged above the center of gravity S indicated in FIG. 5, of the mounting unit formed by the bobbin carrier 10 and the stock bobbin 4, so that the wall part 32 of the suspended bobbin carrier 10 when at any time in a vertical or slightly inclined position for delivery, may be seized by the gripper 28. The wall part 32 contains openings 37 for receiving the studs 31 provided on the gripper 28 as well as at least one spikelike bobbin holder 38 onto which when in the preparation station 8 at any time, one of the stock bobbins 4 may be slipped by the bobbin tube 4*a*. On the lower flange part 33 a base portion is formed, provided with centering holes 40 by which the bobbin carrier 10 or 10' may be mounted on a holder part 41 or 41*a* of the bobbin frame 3, which is provided with centering studs 42 which may be introduced into the centering holes 40.

Each bobbin carrier 10 and 10' contains a yarn guide unit 45 arranged on a stirrup-like supporting part 44 and having an eye 43 passing through it, for receiving, securing and releasing the piece A at the start of the weft yarn 5 wound onto the stock bobbin 4 in question.

The supporting part 44 is able to pivot on the flange parts 33 and 34 about an axis running in parallel with the wall part 33, between a normal position in which the yarn guide unit 45 is lying at a distance radially from the stock bobbin 4 which is to be received, and a deflected position in which the yarn guide unit 45 is lying at a distance axially from the stock bobbin 4 in the region of the produced longitudinal axis L of the bobbin holder 38.

The holding parts 41 and 41*a* are hinged to the bobbin frame 3 to be able to swing about a vertical axis 46 and are together supported to be adjustable at option by an adjuster mechanism 47 between the first position (shown in solid line) and a second position (shown in dash-dot line). In the first position the holding part 41*a* adopts an operating position which corresponds with an operating position of the associated first bobbin carrier 10 aligned with the common guide member 6, while the holding part 41 adopts a charging position which allows an easy exchange of the associated second bobbin carrier 10. In the second position the holding part 41 adopts a corresponding operating position 41' directed at the yarn guide member 6 while the holding part 41*a* adopts a charging position 41*a'*. In accordance with the illustration the adjusting mechanism 47 may contain a pneumatic piston/cylinder unit 50 which is hinged to a carrier plate 48 of the bobbin frame 3 and the piston rod 51 of which may be coupled to the holding parts 41 or 41*a* via two driver discs 52 and 52*a* which are adjustable relatively to one another, and two drivers 53 and 53*a*. By loosening the driver 53 or 53' respectively from the driver disc 52 or 52*a* the holding parts 41 and 41*a* may be uncoupled and placed by hand in the other position of swing at the time and/or—beyond the charging position—in a service position (not shown) which may be adopted in the bobbin alley, in which, e.g., the stock bobbin 4 not active at the time or possibly defective may be exchanged without interruption of the running of the machine or some trouble in operation may be cleared.

An embodiment is also possible in which corresponding holding parts are connected rigidly together and coupled directly to the or a corresponding adjusting mechanism. Again, instead of separate holding parts a single common holding part may be provided for the bobbin carrier 10.

Figure 5:
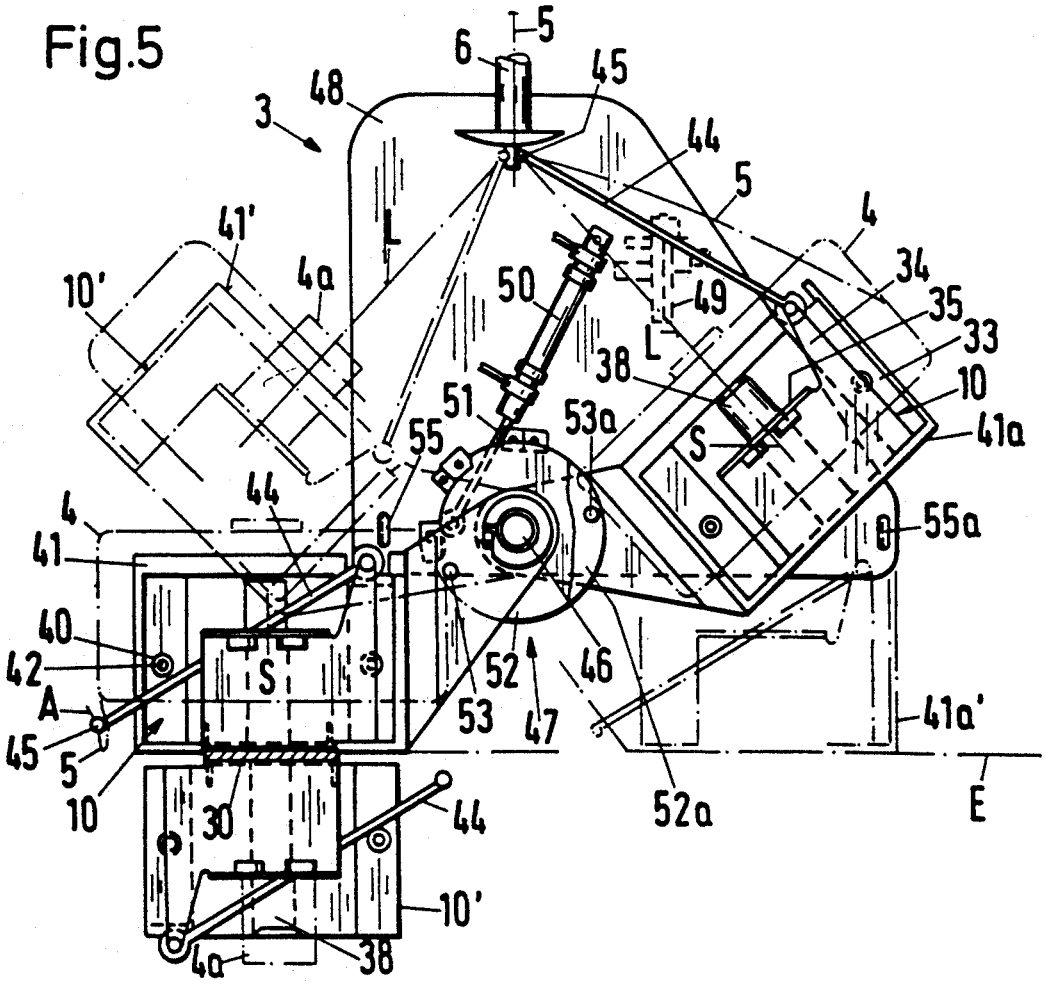
FIG. 5 the detail according to FIG. 4 in plan.

In accordance with FIG. 5, in the operating position of the holding part 41*a* the yarn guide unit 45 is held in the suction region of the suction tube 6 so that the weft yarn 5 is drawn off the stock bobbin 4. The holding part 41 held in the charging position lies with the corresponding charging position 41*a'* of the holding part 41*a* in one vertical plane E which preferably runs in parallel with the bearer rails 17, 17*a*. All of the bobbin frames 3 next to the same alleyway may accordingly be reached by the charging mechanism 16 in one single associated charging position of the bearer rails 17, 17*a*.

The charging process may be started at any time within the relatively long operating phase during which the weft yarn 5 is being drawn off the active stock bobbin 4. For exchanging the bobbin carrier 10' which contains the empty bobbin tube 4*a* or a defective stock bobbin 4 and in accordance with FIG. 5 at the preceding change of bobbin was swung by the holding part 41 out of the operating position shown in dash-dot line towards the plane E, a bobbin carrier 10 charged with the corresponding fresh stock bobbin 4 is taken by the correspondingly controlled charging mechanism 16 off the carrier 22 and carried towards the bobbin frame 3. In doing so, the mounting 30 of the gripper 28 may be turned through 180° with respect to the illustration according to FIG. 2, so that the side of the mounting 30 remote from the fresh stock bobbin 4 may be brought together with the bobbin carrier 10' which is lying on the holding part 41 and is to be exchanged, and the latter removed from the holding part 41. After turning the mounting 30 through a further 180° so that the bobbin carrier 10' arrives in the position represented in solid line in FIGS. 3 and 5, the bobbin carrier 10 charged with the fresh stock bobbin 4 is mounted on the holding part 41 and centered by the centering studs 42 in the definite position represented in FIG. 5. Then the mounting 30 is loosened from the bobbin carrier 10 and the bobbin carrier 10' lying on the mounting 30 is carried back by a corresponding reverse motion of the manipulator arm 24 towards the gap arising in the transport unit 11 at the preceding removal of the fresh stock bobbin 4, and suspended on the carrier 22.

In this way "idle strokes" of the manipulator arm 24 may be avoided and thereby relatively short charging times per loom or per group of looms may be achieved. Since at any time the same carrier 22 can receive both the bobbin carrier 10 for the fresh stock bobbin 4 and the bobbin carrier 10' for the empty bobbin tube 4*a*, all of the carriers 22 present in the same transport unit 11 are available for receiving the bobbin carriers 10 or 10' respectively.

When the stock bobbin 4 lying on the holding part 41*a* has been unwound, a corresponding signal is transmitted by a known (not shown) yarn monitor to a control device 49 of the loom, via which the adjusting mechanism 47 may be controlled. Through corresponding actuation of the adjusting mechanism 47 the holding parts 41 and 41*a* are swung into the positions 41' and 41*a'* represented in dash-dot line. In doing so a driving part, shown as a gearwheel 54, arranged to turn with the pivot of the stirruplike carrier part 44, may come into engagement with a stationary adjusting part arranged in its range of swing, which contains a rack segment 55 or 55*a* which may be fastened, say, to a bearer 56 fitted to the bearer plate 48. The carrier part 44 lying on the holding part 41 is accordingly swivelled from the normal position shown in solid line into the deflected position shown in dash-dot line, in which the yarn guide element 45—in the operating position 41' of the holding part 41—arrives in the region of the inlet to the suction tube 6. In a corresponding way the carrier part 44 lying on the holding part 41*a* in the region of the rack segment 55*a* is swung back from the deflected position represented in solid line into the normal position corresponding with the charging position 41*a'*.

Figure 6:
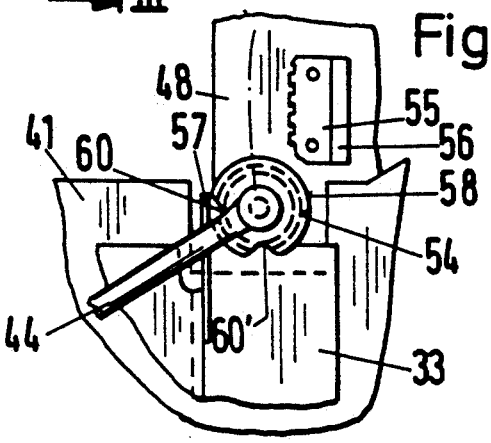
FIG. 6 a detail from FIG. 5 on a larger scale.
Figure 4:
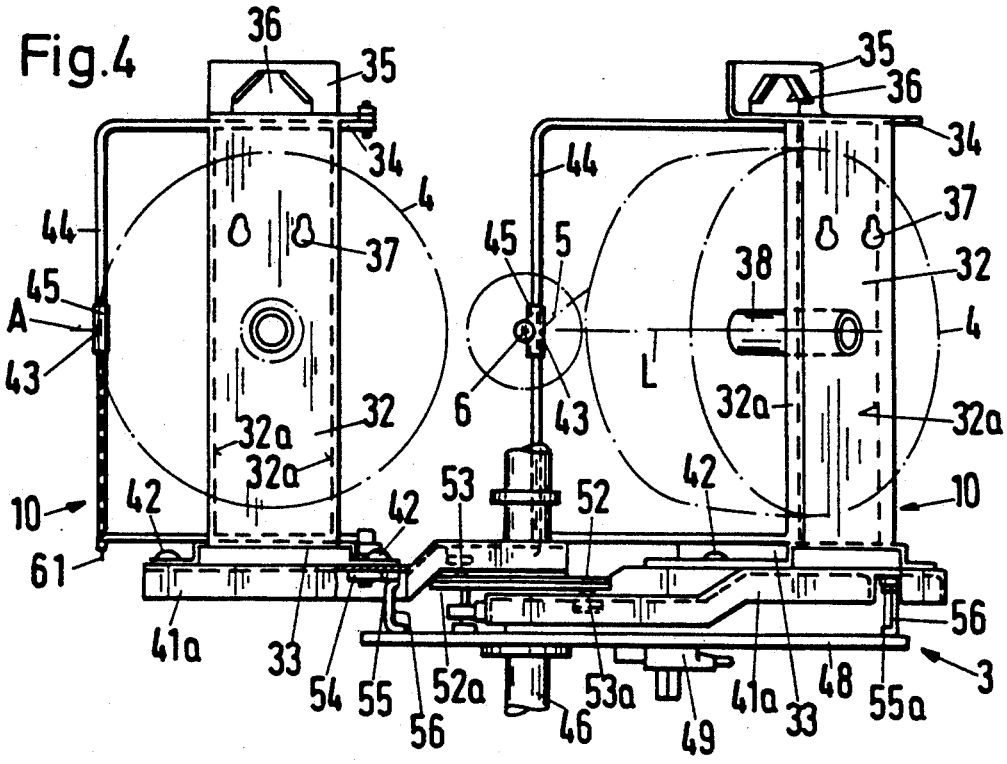
FIG. 4 a detail of the mechanism according to FIG. 2 on a larger scale.

For the location of the normal position and the deflected position of the carrier part 44 a springily arranged stop 57 may be provided on the lower flange part 33, which cooperates with a setting disc 58 fitted to rotate with the pivot of the carrier part 44. In accordance with FIG. 6, the setting disc 58 may be provided with notches 60 and 60' into which the stop 57 can engage in the respective normal position or in the deflected position of the carrier part 44 and lock this carrier part 44.

For securing the starting-piece A of weft yarn lying in the yarn guide unit 45 a gripper pin 61 may be provided. Gripper 6 is arranged in the carrier part 44 and able to be clamped against the starting-piece A lying in the eye 43. Gripper 6 may, in the transfer position of the carrier part 44 associated with the suction tube 6, be adjusted by means (not shown) arranged e.g., on the carrier plate 48, if necessary via the control device 49, into a release position freeing the weft yarn 5 so that the starting-piece A of weft yarn 5 may be fed through the suction tube 6 to the weft insertion mechanism (not shown) of the loom.

The mechanism in accordance with the invention is also suitable for executions with stationary holding parts for the bobbin carriers 10, 10'. The bobbin carriers 10, 10' may each, via the correspondingly controlled charging mechanism 16, be mounted on the holding part in question in the operating position aligned with the suction tube 6 or a corresponding yarn guide member, or respectively removed from it. In that case on each of the holding parts a driveable adjusting element (not shown) may be provided to correspond with, say, the toothed segment 55 or 55*a* (FIG. 6), which, e.g., may be coupled to the gearwheel 54 and by which the carrier part 44 with the yarn guide unit 45 may be adjusted in the way described.

In accordance with the representation according to FIG. 7, the bobbin frame 3 may be executed with four holding parts 41 and 41*a* as well as 41*b* and 41*c* for receiving four bobbin carriers 10 or 10' respectively. The holding parts 41 and 41*a* are adjustable together in the way already described via the piston/cylinder unit 50. The holding parts 41*b* and 41*c* are adjustable via a corresponding piston/cylinder unit 50*a*, in which case the holding part 41*b* is adjustable between the operating position represented in solid line and a charging position 41*b'* represented in dash-dot line. The holding part 41*c* is adjustable between the charging position represented in solid line and an operating position 41*c'* represented in dash-dot line. In their operating positions the holding parts 41 and 41*a* are aligned with the suction tube 6. The holding parts 41*b* and 41*c* in their operating positions are aligned with a second suction tube 6*a*. The two suction tubes 6 and 6*a* are aligned symmetrically with respect to one another on a common (not shown) guide member on the loom, e.g., a guiding eye connected before a yarn store. The weft yarn 5 which is to be inserted can accordingly, as already known, be drawn at option from one of the stock bobbins 4 active at the time. As appears from FIG. 7, the holding parts 40 and 41*a*, or 41*b* and 41*c* coupled in pairs to the same piston/-cylinder units 50 or 50*a*, are able to swivel through different angles of swing between the respective charging position lying in the common plane E and the operating position concerned. For adjusting the carrier parts 44 containing the yarn guide units 45 they may, as represented in particular in FIG. 8, each be provided with a crank-like driving part arranged on the pivot to turn with it, with a driver stud 64 standing out below the bobbin carrier 10 or 10' in question. Driver stud 64 is intended for coinciding with an adjusting part 65 or 65*a* arranged in its range of swing. As appears in particular from FIGS. 7*a* and 7*b*, the adjusting parts 65 and 65*a* may each be formed by a guideplate which may be fastened to the bearer plate 48 and is executed with a guideway 66 or 66*a* corresponding with the angle of swing of the associated holding part 41, 41*c* or respectively 41*a*, 41*b*, for the guide studs 64 standing out from the bobbin carrier 10 or 10'.

In the case of an adjustment of the holding parts 41 and 41*a*, or respectively of the holding parts 41*b* and 41*c*, from the position represented in FIG. 7, the carrier part 44 lying on the holding part 41 or 41*c* respectively, guided by the guideway 65, is guided from the normal position shown towards the region at the inlet to the suction tube 6 or 6*a*, whilst the carrier part 44, lying on the holding part 41*a* or 41*b* and guided by the guideway 65*a*, is carried back from the deflected position as shown into the corresponding (not shown) normal position.

The mechanism in accordance with the invention in a simple way enables gentle transport of the stock bobbins 4 and an exchange, of the empty bobbin tube 4*a* for the fresh stock bobbin 4 as well as a quick transfer from the active bobbin to the standby bobbin. In particular a connection necessary in the case of previous mechanisms of this kind, and having to be performed on the bobbin frame, between the piece of weft yarn lying at the start of the standby bobbin to the piece of weft yarn lying at the end of the active bobbin, is superfluous. The mechanism in accordance with the invention may preferably be applied in connection with a mechanism for automatic removal of a weft yarn which has been inserted in a faulty manner. Through a mechanism of the kind proposed the piece of weft yarn running off the end of the active bobbin may be considered a faulty pick and removed from the shed, whereupon the weft yarn from the standby bobbin made ready by the mechanism in accordance with the invention may without significant delay be inserted into the shed.

Numerous modified embodiments of the invention are possible. Thus, the holding parts 41, 41*a* may be hinged to swing independently of one another from the shaft 46 and each on its own be coupled to the adjusting mechanism 47—or to positioning means of any other construction—to be adjustable between an operating position and a charging position. Corresponding holding parts may also be hinged to the bobbin frame 3, each on a pivot of its own so that it may be adjusted and fixed. In doing so the points of hinge on the holding parts may be so arranged that the axes of pivot imagined produced run each approximately through the center of gravity (not shown) of the stock bobbin 4. An execution is also possible in which the bobbin carriers 10 are fitted by hanging on the bobbin frame 3. The bobbin carriers may further be executed each with a stationary yarn guide unit which may be arranged on a carrier part standing out rigidly from the bobbin carrier concerned and able to be guided towards the region at the inlet to the yarn guide member 6.

According to another embodiment (not shown), corresponding bobbin carriers 10 can also be provided each with two or several bobbin holders 38 arranged side by side or one upon the other for a corresponding number of stock bobbins 4. The weft yarns of the stock bobbins 4 arranged on the same bobbin carrier 10 can be joined together outside the weaving shed, e.g. in the preparation station 8, and the piece at the start of the weft yarn of the one, e.g. the lowest stock bobbin 4, can be inserted into the yarn guide unit 45. This embodiment enables the preparation of a multiple of the weft yarn stock as can be supplied by previous mechanisms during a charging process. Accordingly, this embodiment is especially advantageous in combination with looms for large weft insertion rates.

We claim:

1. A mechanism for feeding weft-yarn stock bobbins to a loom and for carrying away from the loom spent stock bobbins, the mechanism comprising:

a bobbin carrier having at least one bobbin holder supporting a fresh stock bobbin, the fresh stock bobbin having a piece of yarn at a start of a weft yarn, and the bobbin carrier also including a yarn guide unit having means for releasably securing the piece of yarn at the start of the weft yarn;

a bobbin frame, adapted to be associated with the loom, having at least one bobbin holder configured to receive one stock bobbin;

a yarn guide member adapted to be associated with the loom and configured to receive the piece of yarn at the start of the weft yarn from the yarn guide unit of the bobbin carrier;

a charging mechanism having means for carrying the bobbin carrier and being movable towards and away from the bobbin frame for exchanging the fresh stock bobbin for the spent stock bobbin; and a delivery device for feeding to the yarn guide member the piece at the start of the weft yarn on the fresh stock bobbin carried by the bobbin carrier.

2. A mechanism as in claim 1, wherein the yarn guide unit is formed on a stirruplike carrier part which is hingedly attached to the bobbin carrier for movement between a starting position, which adjoins a peripheral region of the fresh stock bobbin, and a deflected position provided for at an axial distance from the stock bobbin, in which the yarn guide unit is lying in a predetermined operating position of the bobbin carrier in a lead-in region of the common yarn guide member.

3. A mechanism as in claim 1, wherein the yarn guide unit further comprises:

an eye sized to receive the piece at the start of the weft yarn; and the releasably securing means for the piece at the start of the weft yarn includes a gripper part.

4. A mechanism as in claim 3, wherein the gripper part is formed by a holder element arranged on the carrier part and is adapted to be movable between a securing position, in which the gripper part is adjacent the piece at the start of the weft yarn in the eye, and a removal position, in which the gripper part is spaced apart from the eye so that the piece at the start of the weft yarn may be removed.

5. A mechanism as in claim 1, wherein:

the bobbin carrier has at least two bobbin holders and means for adjusting the at least two bobbin holders between a first angular position aligned on the yarn guide member and a second angular position aligned on a charging position of the charging mechanism; and the bobbin frame further comprises holding parts configured to receive the bobbin carrier, each holding part having means for hinging the holding part to the bobbin frame so that the holding part can swivel about an upright axis between an operating position, corresponding with the first angular position of the bobbin holder, and a charging position, corresponding with the second angular position of the bobbin holder.

6. A mechanism as in claim 5, wherein the holding parts are hingedly arranged on the bobbin frame with a range of swing such that the bobbin carriers occupying the charging position, which are associated with the loom, and the bobbin carriers occupying the corresponding charging position on at least one loom adjacent the loom, lie in a common vertical plane.

7. A mechanism as in claim 5, wherein the swivelling holding parts of the bobbin frame are coupled to an adjusting mechanism energized via a device for controlling the loom.

8. A mechanism as in claim 1, further comprising a driving part drivingly coupled to the yarn guide unit, the driving part having a driving part range of swing.

9. A mechanism as in claim 8, further comprising an adjusting part arranged to be stationary in the driving part range of swing.

10. A mechanism as in claim 1, further comprising:

a transport mechanism movable between a number of looms;

a gripper member carried by the transport mechanism, the gripper member having a bobbin carrier support configured to support the bobbin carrier; and wherein the bobbin carrier has a wall part from which the bobbin holder extends, the wall part having a support surface configured to matingly engage the bobbin carrier support so that the gripper member and the transport mechanism can carry the bobbin carrier.

11. A mechanism as in claim 10, wherein:

the bobbin carrier further comprises a bottom portion extending from the wall part and an upper flange portion extending from the wall part, the wall part, bottom portion, and upper flange portion forming a casing partially surrounding the stock bobbin; and the carrier part is hingedly coupled to the bottom portion and the upper flange portion.

12. A method for feeding weft-yarn stock bobbins to a loom and for carrying away from the loom spent stock bobbins comprising the following steps:

freeing the spent stock bobbin from a yarn guide member associated with the loom;

taking a bobbin carrier having a fresh stock bobbin from a transport mechanism with a charging mechanism;

carrying the spent stock bobbin from a bobbin frame with the charging mechanism to the transport mechanism;

charging the bobbin frame with the fresh stock bobbin taken from the transport mechanism by the charging mechanism; and bringing a yarn guide unit carried by the bobbin carrier together with the yarn guide member associated with the loom.

* * * * *